United States Patent [19]

Nakatani et al.

[11] Patent Number: 4,999,596

[45] Date of Patent: Mar. 12, 1991

[54] SECOND-HARMONIC-WAVE CHOCKING FILTER

[75] Inventors: Tetsuji Nakatani; Akira Watanabe, both of Nishi, Japan

[73] Assignee: Fujitsu Limited, Kawasaki, Japan

[21] Appl. No.: 442,507

[22] Filed: Nov. 28, 1989

[30] Foreign Application Priority Data

Dec. 2, 1988 [JP] Japan ..... 63-306351

[51] Int. Cl.[5] ..... H01P 1/203

[52] U.S. Cl. ..... 333/204; 333/202; 333/246

[58] Field of Search ..... 333/204, 205, 246, 238, 333/219, 202, 33

[56] References Cited

U.S. PATENT DOCUMENTS

| | | | |
|---|---|---|---|
| 3,343,069 | 9/1967 | Tsuda | 333/204 X |
| 3,345,589 | 10/1967 | Di Piazza | 333/204 |
| 3,875,538 | 4/1975 | Minet et al. | 333/238 X |
| 4,074,214 | 2/1978 | Archholzer | 333/204 |
| 4,288,766 | 9/1981 | Okita | 333/204 |
| 4,489,292 | 12/1984 | Ogawa | 333/246 |

FOREIGN PATENT DOCUMENTS

| | | | |
|---|---|---|---|
| 0141005 | 8/1983 | Japan | 333/204 |
| 0045601 | 3/1986 | Japan | 333/204 |

*Primary Examiner*—Eugene R. Laroche
*Assistant Examiner*—Seung Ham
*Attorney, Agent, or Firm*—Staas & Halsey

[57] ABSTRACT

A strip-type second-harmonic-choking filter is constituted such that a main transmission line, through which a fundamental frequency wave is to be transmitted, is connected with first and second stub. The first stub exhibits a first susceptance value for the fundamental frequency and exhibits a subtantially infinite admittance value for a second harmonic of the fundamental frequency, on one side of said main transmission line. A second stub exhibits a second susceptance value which is essentially a conjugate of the first susceptance value for the fundamental frequency and exhibits an infinity or zero admittance value for the second harmonic frequency, at an opposite side of the transmission line from the first stub. For the fundamental frequency wave, the two stubs cancel the effects of each other so that no effect is given on the transmission of the fundamental wave, while one or both of the stubs choke the transmission of the second-harmonic wave. The stub may be bent so that more area is easily available for circuits to be installed on the same circuit board.

10 Claims, 6 Drawing Sheets

FUNDAMENTAL FRQ. WAVE
2ND HARMONIC FREQ. WAVE
λg(2n+3)/8 OPEN STUB
λg(2n+1)/8 OPEN STUB
INDUCTIVE
CAPACITIVE n=0
CAPACITIVE
INDUCTIVE n=1
INDUCTIVE
CAPACITIVE n=2
MAIN TRANSMISSION LINE

FUNDAMENTAL FREQ. WAVE
2ND HARMONIC FREQ. WAVE
λg(2n+1)/8
SHORT STUB
λg(2n+1)/8
OPEN STUB
INDUCTIVE
CAPACITIVE n=0
EQUIVALENT TO OPEN
EQUIVALENT TO BE SHORTED
CAPACITIVE
INDUCTIVE n=1
EQUIVALENT TO BE OPEN
EQUIVALENT TO BE SHORTED
INDUCTIVE
CAPACITIVE n=2
EQUIVALENT TO BE OPEN
EQUIVALENT TO BE SHORTED
MAIN TRANSMISSION LINE

INPUT SPECTRUM

OUTPUT SPECTRUM

SECOND-HARMONIC-WAVE CHOCKING FILTER

BACKGROUND OF THE INVENTION

1. Field of the Invention

The present invention relates to a second-harmonic choking filter employed in a strip type microwave transmission line.

2. Description of the Related Art

In a microwave radio transmission apparatus, there is employed a frequency converter which includes a local frequency oscillator outputting a local frequency $f_{LO}$ and a non-linear element, such as a diode or a transistor, so as to convert an input signal having frequency $f_s$ to a signal having a frequency $(f_{LO}-f_s)$ or $(f_{LO}-f_s)$. At this time, unnecessary signals, spurious emissions, having frequencies $2f_{LO}$, $3f_{LO}$ . . . are also output. Among these frequencies, the second harmonic wave $2f_{LO}$ of the local oscillator is of the highest level, and sometimes becomes even higher than the level of the necessary frequency-converted signal. Therefore, a second-harmonic choking filter provided therein must fully choke, i.e. prevents, the second-harmonic wave to propagate, while the performance of the necessary signal is not deteriorated even installed in a limited space and its adjustment must be easy.

FIG. 1 shows a prior art structure of a second-harmonic wave choking filter formed with a strip-type transmission line; and FIG. 2 shows an admittance Smith Chart for explaining the operation of FIG. 1 filter circuit. From the left hand side into FIG. 1 filter a fundamental frequency wave to be transmitted therethrough and its second harmonic wave to be choked thereby are simultaneously input. As shown in FIG. 1, a main transmission line 2 constituted of a strip-type transmission line is provided with open stubs 1 and 3, each constituted of the same strip-type transmission line as the main transmission line 2, having the longitudinal length of Lg/8, and each separated by a distance L along the main transmission line 2, where Lg indicates an effective wavelength of the fundamental frequency wave on the transmission lines 1, 2 and 3. Accordingly, these open stubs 1 and 2 have effectively a quarter wave length for the second-harmonic frequency wave. When the open stubs 1 and 3 are connected to an arbitrary position A on the main transmission line 2, the admittance looking at the right hand side of the main transmission line 2 is the characteristic admittance $Y_O$ of the main transmission-line because of no reflection, therefore, falls on the center of the admittance Smith Chart of FIG. 2. The open stub 1 having the wave length Lg/8 connected to the position A shifts the above-described admittance from the center to an admittance denoted with $A_1$ in FIG. 2. Therefore, a part of the fundamental wave on the main transmission line 2 is reflected, and the rest is transmitted towards the output side, i.e. the right hand side of the main transmission line. At this state, the second-harmonic wave is fully reflected at position A because the open stub 1 having a quarter wavelength of the second-harmonics wave looked at from position A exhibits an infinite admittance, i.e. equivalent to a shorted state. At a position B which is advanced on the main transmission line by a distance L from position A, if the second open stub 3 is not connected to the main transmission line 2 yet, the admittance becomes that denoted with the point $A_2$, which is the conjugate of point $A_1$, on FIG. 2. Then, by connecting the second stub 3 having the same length, i.e. same admittance as that of the first stub 1, to position B the admittance $A_2$ is canceled so as to move back to the center. In other explanation, a of the fundamental frequency wave is reflected also at position B; however, the reflected wave at position B cancels the reflected wave at position A. Thus, the transmission line 2 allows the fundamental wave to propagate to the right hand side without reflection.

When the distance L between the two stubs 1 and 3 is varied, the impedance moves along the most central coaxial circle $C_1$ of FIG. 2. When the length of the stub connected to position B is varied, it moves on the left hand side circle $C_2$.

In the FIG. 1 structure, when the frequency of the fundamental wave is determined, the lengths of the open stubs 1 and 3 and the distance therebetween are uniquely determined. However, considerable area of the printed circuit board is required for installing the stubs. When the available space is limited, the main transmission line 2 must be bent, causing a deterioration of the characteristic impedance. When the actual performance is different from the designed target performance, the stub lengths and the distance L therebetween must be adjusted. Thus, there is a problem in that the limited space may deteriorate the characteristics as well as require complicated adjustments.

SUMMARY OF THE INVENTION

It is an object of the invention to provide a strip-type second-harmonic wave choking filter circuit which requires less area for its installation without deterioration of the performance as well as requires less complicated adjustments.

According to the present invention, a first stub which is a $Lg(2n+1)/8$ long open stub and a second stub which is a $Lg(2n+3)/8$ long open stub or a $Lg(2n+1)/8$ long short stub are respectively connected to both sides, facing each other, of a main transmission line, where Lg indicates an effective wavelength of a fundamental frequency wave on the strip-type transmission lines constituting the stubs and the notation n indicates zero or a positive integer.

For the fundamental frequency wave to be transmitted through the main transmission line, the first and the second stubs exhibits conjugate susceptance values to each other; therefore the two stubs cancel the effect of each other, thus together give no effect on its propagation on the main transmission line. On the other hand, for the second-harmonic frequency wave, admittance value of the first stub is infinity, i.e. equal to a shorted state, causing complete reflection of the second-harmonic wave. The second stub exhibits infinity or zero admittance, respectively, i.e. a shorted state or an open state. Thus, the second-harmonic wave is completely reflected thereby.

The above-mentioned features and advantages of the present invention, together with other objects and advantages, which will become apparent, will be more fully described hereinafter, with reference being made to the accompanying drawings which form a part hereof, wherein like numerals refer to like parts throughout.

DESCRIPTION OF THE PREFERRED EMBODIMENTS

Figure 1:
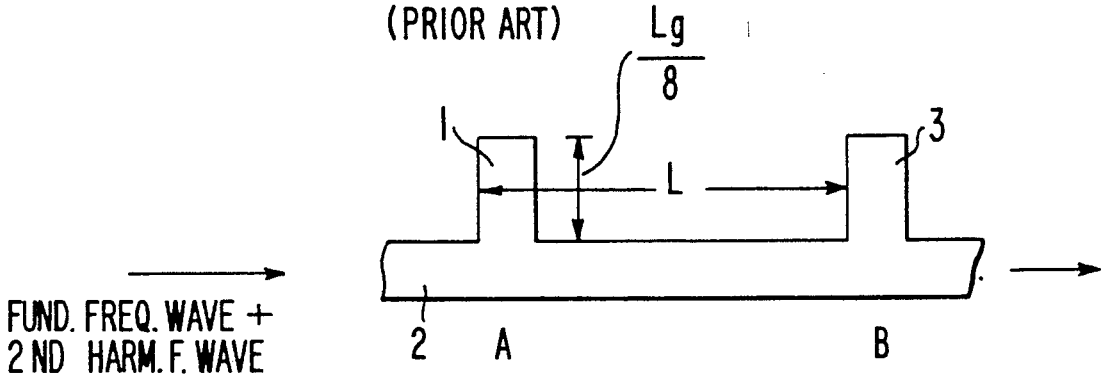
FIG. 1 (PRIOR ART)
FIG. 1 shows a configuration of a prior art second-harmonic wave choking filter.
Figure 2:
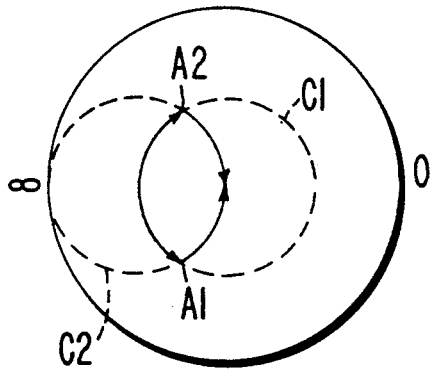
FIG. 2 shows an admittance Smith Chart explaining the performance of the filter circuit shown in FIG. 1.
Figure 3:
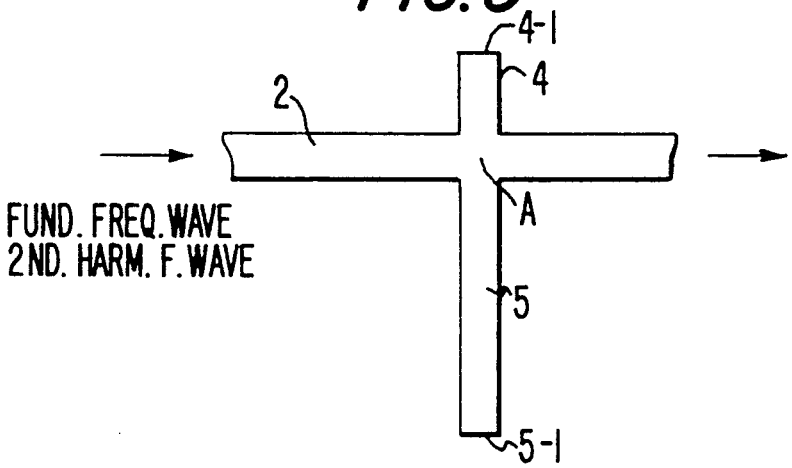
FIG. 3 shows a configuration of a preferred embodiment of the present invention.

FIG. 3 schematically illustrates a plan view of a preferred embodiment of a second harmonic-wave choking filter according to the present invention. The same notations denote the same subjects throughout the figures. A main transmission line 2 is of a generally employed strip-type transmission line. Here, a strip-type transmission line is such that widely known as comprising an flat sheet electrode as a ground electrode (not shown in the figures) on a side of a sheet of dielectric material, such as, fluorocarbon polymer filled with glass-wool or ceramic, and a strip-line electrode (seen in FIGS. 1, 3, 5 and 9) on the other side of the dielectric sheet. The fluorocarbon polymer sheet filled with glass-wool is approximately 0.4 mm thick. The strip-line electrode is formed with an approximately 1 mm wide, 0.035 mm thick copper layer, so as to exhibit a 50 ohm characteristics impedance. Both a fundamental frequency wave to be transmitted along the main transmission line and its second-harmonic wave to be choked are input to the left hand side end of the main transmission line 2, as denoted with an arrow. Effective wavelength Lg of an electromagnetic wave measured along the strip-type transmission line is shorter than that of a strip-type transmission line having an air gap in place of the dielectric material, because the dielectric material forming the strip-type transmission line shrinks the wavelength by $1/\sqrt{\epsilon}$, where $\sqrt{}$ indicates a dielectric constant of the material of the dielectric sheet. An $Lg(2n+1)/8$ long first open stub 4 is connected to a side of the main transmission line 2 at an appropriate phase position A of the main transmission line 2, and an $Lg(2n+3)/8$ long second open stub 5 is connected to an opposite side from the first open stub 4 with respect to the main transmission line 2, i.e. at the same phase position A of the main transmission line 2. In the above recited formulas, the notation n indicates zero or an positive integer. A term "open stub" represents a transmission line whose one end 4-1 or 5-1 is terminated with nothing, that is, open, and the other end is to be connected to the main transmission line. In the preferred embodiments shown in FIG. 3 the value of the notation n is chosen to be zero as the simplest example. That is, the length of the first and the second stubs 4 and 5 are Lg/8 and 3 Lg/8, respectively. Characteristic admittance $Y_O$, which is inverse of the characteristic impedance and is determined by the width of the strip line electrode, of the stubs 4 and 5 is generally, and now, chosen same to that of the main transmission line as described above. Thus, the width of the stubs 4 and 5 is now chosen 1 mm. At this state, the wavelength Lg in the stubs is 51.2 mm for a 4 GHz input fundamental wave, because the dielectric constant C of the dielectric material forming the transmission line is 2.6. Then, the first open stub 4 becomes 6.4 mm long as well as the second open stub 5 becomes 19.2 mm long, each measured from each side of the strip-line of the main transmission line 2.

Figure 4:
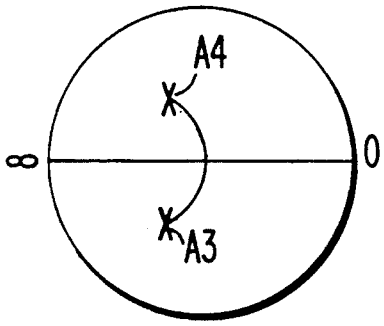
FIG. 4 shows an admittance Smith Chart explaining the performance of the filter circuit shown in FIGS. 3 and 4.

Performance of the stubs 4 and 5 for the fundamental frequency wave is hereinafter described. The Lg/8 long first open stub 4, looked at from position A, exhibits a capacitive susceptance value $+jY_O$ When this susceptance $+jY_O$ is connected in parallel to the $Y_O$ of the main transmission line 2, the summed admittance value $Y_O+jY_O$ is shown with point $A_3$ in the admittance Smith Chart in FIG. 4. The 3 Lg/8 long second open stub 5, looked at from position A, exhibits an inductive susceptance value $-jY_O$ When this susceptance value $-jY_O$ is connected in parallel to the $Y_O$ of the main transmission line 2, the summed admittance value $Y_O-jY_O$ is shown with point $A_4$ on the admittance Smith Chart in FIG. 4. Therefore, the first stub 4 and the second stub 5, each having conjugate susceptance value, i.e. an equal value of opposite sign, connected to the same place, position A, cancel the effect of each susceptance. Then, the summed admittance value goes back to the center of the admittance Smith Chart. Thus, the existance of the first stub 4 and the second stub 5 does not affect the admittance, i.e. the performance, of the fundamental frequency wave to propagate along the main transmission line 2.

For the second-harmonic wave, the stubs 4 and 5 perform as hereinafter described. The length Lg/8 of the fundamental frequency wave on the first open stub 4 is subtantially equivalent to a quarter of the second-harmonic wavelength. Accordingly, this is of a resonant state where the admittance looked at from position A exhibits infinity, that is equivalent to a shorted state. The length 3 Lg/8 of fundamental frequency wave on the second open stub 5 is equivalent to $\frac{3}{4}$ of the second-harmonic wave. Accordingly, this is also of a resonant state where the admittance looked at from position A exhibits also infinity. Thus, the second-harmonic wave on the main transmission line 2 is reflected, i.e. choked, by the existance of the stubs 4 and 5.

Figures 6A, 6B, 6C:
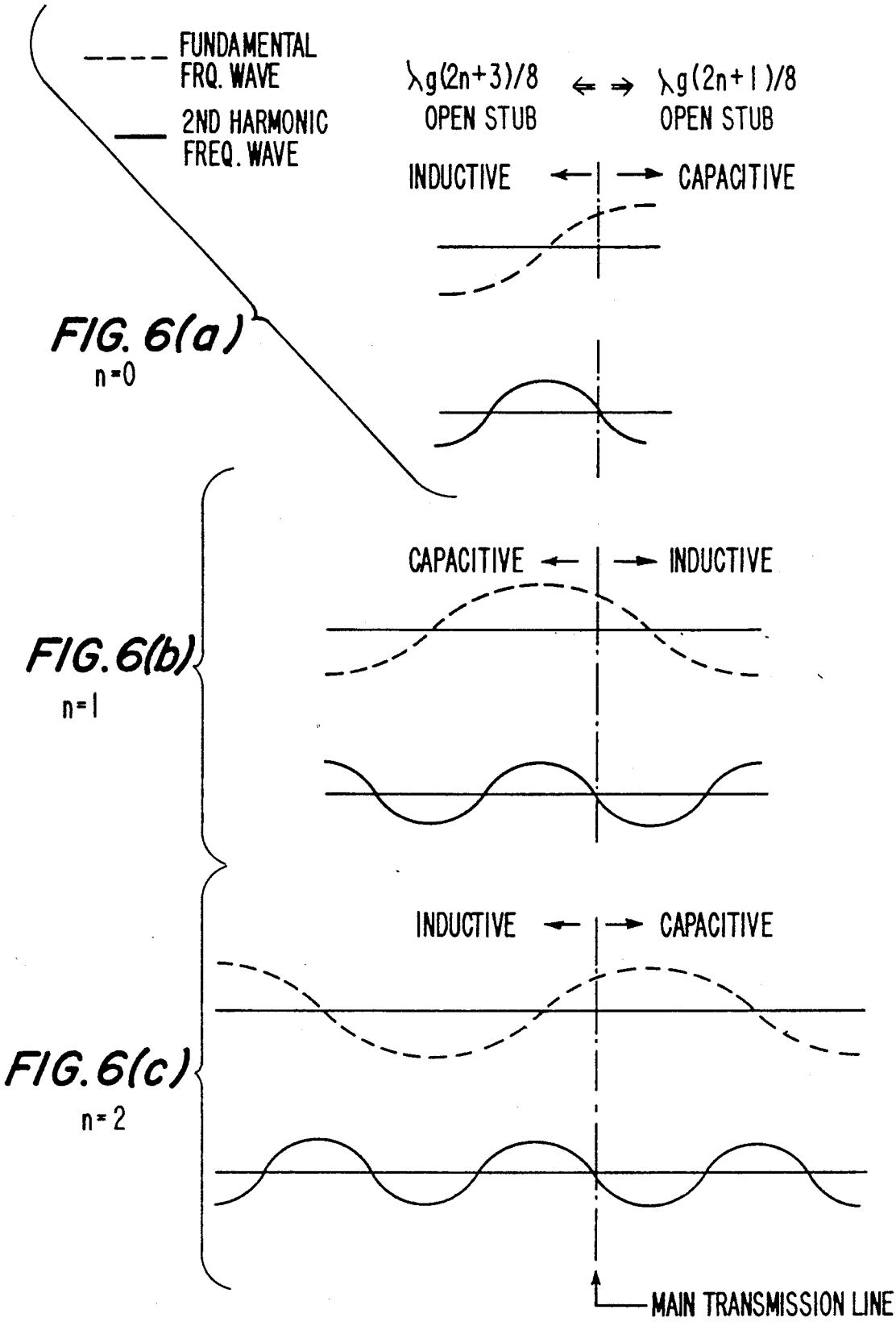
FIGS. 6(*a*) to 6(*c*) show voltage standing-waves on the stubs of the preferred embodiment shown in FIG. 3.

Voltage standing waves of the fundamental frequency wave and the second harmonic wave on the open stubs 4 and 5 are schematically illustrated in FIGS. 6(*a*)–6(*c*), where dotted lines show the fundamental frequency wave and solid lines show the second harmonic waves.

Figure 5:
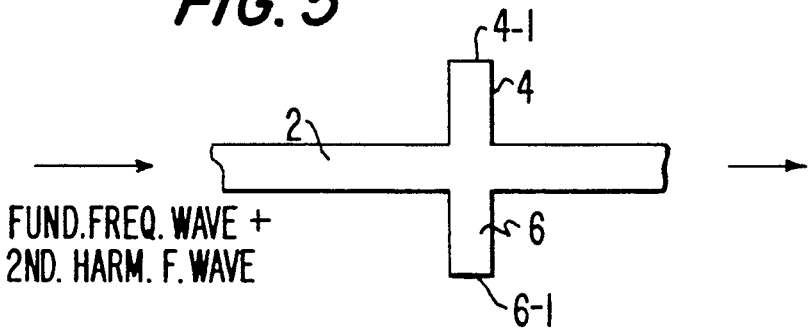
FIG. 5 shows a second preferred embodiment of the present invention.

A second preferred embodiment of the present invention is schematically illustrated in FIG. 5. In FIG. 5, the open stub 4 is identical to the open stub 4 of the first preferred embodiment shown in FIG. 3. That is, an $Lg(2n+1)/8$ long open stub 4 is connected to a side of the main transmission line 2 at an arbitrary phase position A of the main transmission line 2, and an $Lg(2n+1)/8$ long short stub 6 is connected to an opposite side from the open stub 4 with respect to the main transmission line 2, i.e. at the same phase position A of the main transmission line A. In the above recited formulas, the notation n indicates zero or an positive integer. A term "short stub" represents a transmission line whose end 6-1 is shorted, and the other end is to be connected to the main transmission line. In the preferred embodiments shown in FIG. 5 the value of the notation n is chosen to be zero as the simplest example. That is, both the open and the short stubs 4 and 6 are Lg/8 long. Characteristic admittance $Y_O$ of the stubs 4 and 6 is typically, and now, chosen same to that of the main transmission line. Thus, the short stub 6 is approximately 1 mm wide and a 6.4 mm long measured from the side of the strip line of the main transmission line 2.

Performance of the stubs 4 and 6 for the fundamental frequency wave is subtantially equivalent to the performance of the first open stub 4 and the second open stub 5 of the first preferred embodiment shown in FIG. 3, as described below. The Lg/8 long open stub 4, looked at from position A, exhibits a capacitive susceptance value $+jY_O$. When this susceptance $+jY_O$ is connected in parallel to the $Y_O$ of the main transmission line 2, the summed admittance value $Y_O+jY_O$ is shown with point $A_3$ in the summed admittance Smith Chart in FIG. 4. The Lg/8 long short stub 6, looked at from position A, exhibits an inductive susceptance value $-jY_O$. When this susceptance value $-jY_O$ is connected in parallel to the $Y_O$ of the main transmission line 2, the summed admittance value $Y_O-jY_O$ is shown with point $A_4$ on the admittance Smith Chart in FIG. 4. Therefore, the open stub 4 and the short stub 6, each having conjugate susceptance value connected to the same place, position A, cancel the effect of each susceptance. Then, the summed admittance value goes back to the center of the admittance Smith Chart. Thus, the existance of the open stub 4 and the short stub 6 does not affect the admittance, i.e. the performance, of the fundamental frequency wave to propagate along the main transmission line 2.

For the second-harmonic wave the stubs 4 and 5 perform as hereinafter described. The length Lg/8 of the fundamental frequency wave on the stubs is equivalent to $\frac{1}{4}$ of the second-harmonic wavelength. Accordingly, the admittance of the open stub 4 looked at from the main transmission line 2 exhibits infinity, that is equivalent to a shorted state, as well as the short stub 6 is also of a resonant state where its admittance looked at from the main transmission line 2 exhibits zero, equivalent to an open state, i.e. nothing connected there. Thus, the second-harmonic wave on the main transmission line 2 is reflected, i.e. choked, by the existance of the short stub 4, while being not affected by the existance of the short stub 6.

Figures 7A, 7B, 7C:
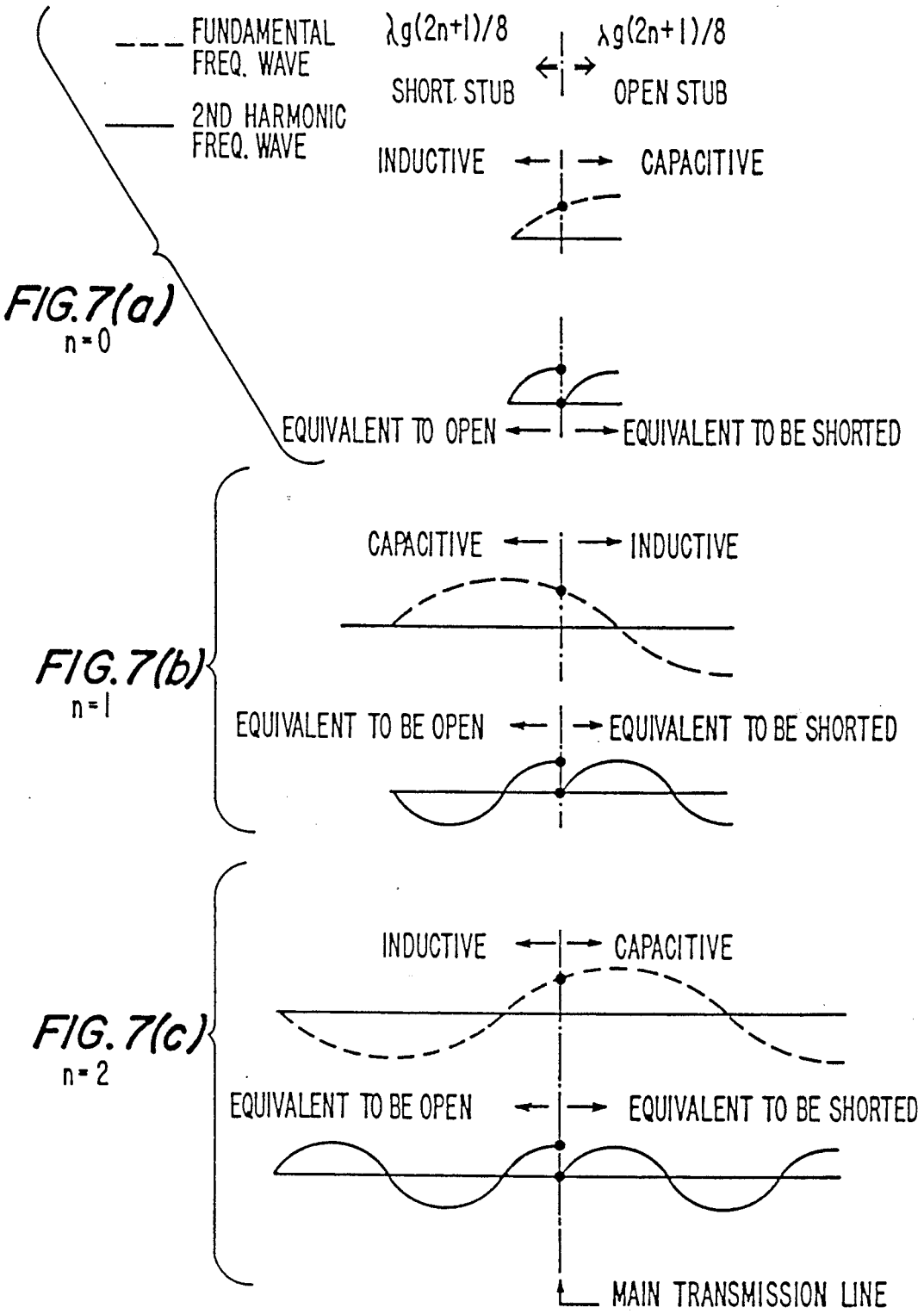
FIGS. 7(*a*) to 7(*c*) show voltage standing-waves on the stubs of the preferred embodiment shown in FIG. 5.

Voltage standing waves of the fundamental frequency wave and the second harmonic wave on the open stub 4 and the short stub 6 are schematically illustrated in FIGS. 7(*a*)–7(*c*), in the same way as in FIGS. 6.

Figure 8:
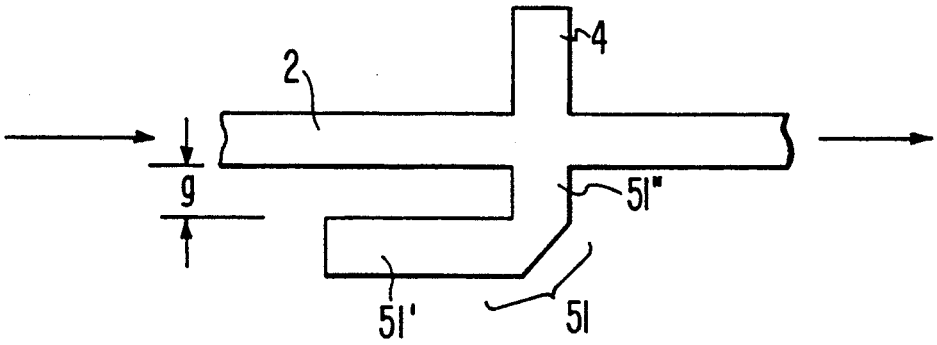
FIG. 8 shows a configuration of a third preferred embodiment of the present invention.

A third preferred embodiment of the present invention is shown in FIG. 8. In FIG. 8, the first open stub 4 is identical to that of the first preferred embodiment shown in FIG. 3. The second open stub 51 is bent so that the top part 51' of the stub 51 is approximately parallel to the main transmission line 2. Thus, the bent top portion 51' is 9.7 long measured from the inner corner with the root portion 51''. The gap g between the main transmission line 2 and the bent top portion 51' of the second stub is 9 mm, which is wide enough to avoid undesirable electriomagnetic coupling therebetween. Width of this gap g is preferably chosen at least the same as the width of the wider one of the widths of the main transmission line 2 or the second open stub 51. Outer edge of the bent corner is slanted in order to cancel an edge effect, which disturbs characteristic admittance of the stub 51, according to a generally known technique. Performances, i.e. effects, of the bent stub 51 on the main transmission line 2 are subtantially identical to those of the second open stub 5 of the first preferred embodiment.

Figure 9A:
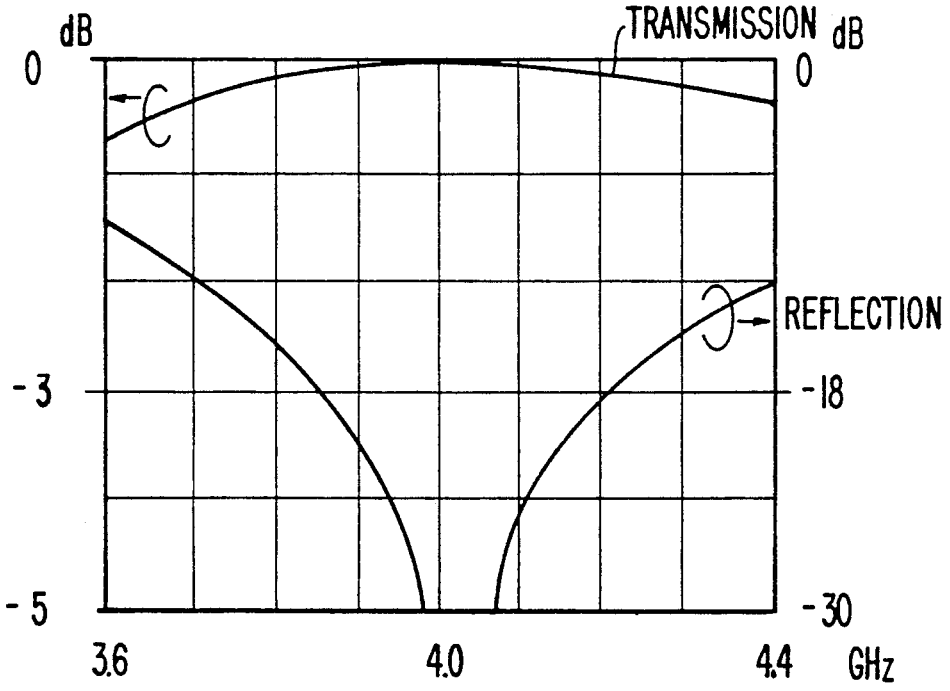
FIGS. 9(*a*) to 9(*b*) show frequency characteristics of the filter of the preferred embodiment shown in FIG. 8.
Figure 9B:
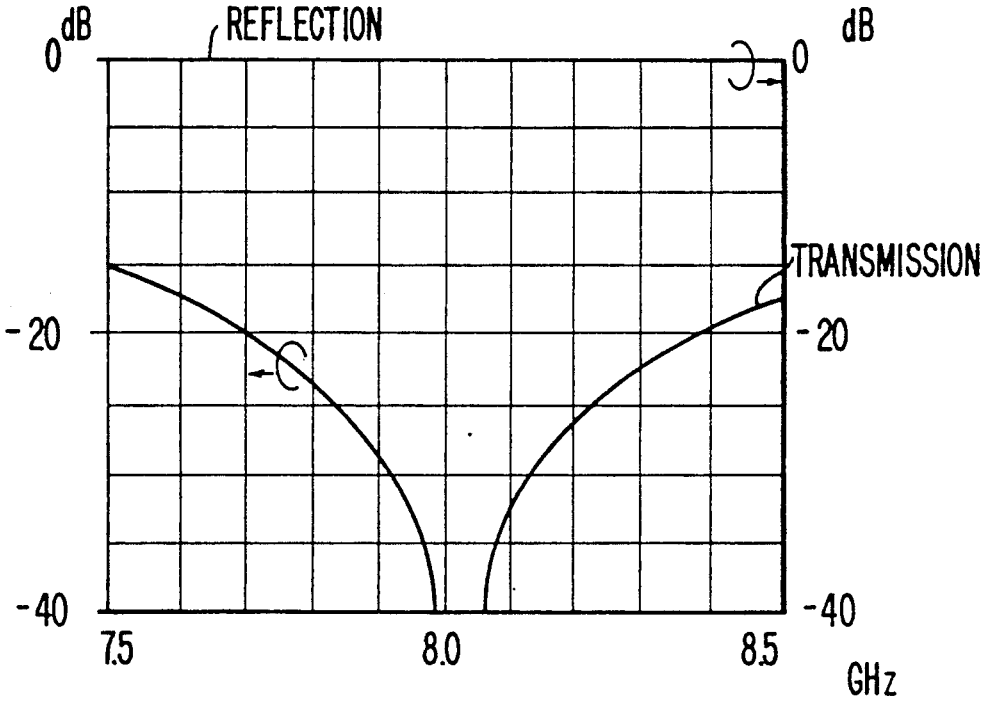

Frequency characteristics of the preferred embodiment shown in FIG. 8 are shown in FIGS. 9. FIG. 9(*a*) shows a pass band characteristics and a reflection characteristics of the fundamental frequency wave, versus the input frequency. The reflection characteristics is a ratio of the reflected power to the incident power, accordingly, indicates the attenuation characteristics. FIG. 9(*b*) shows the same characteristics for the second-harmonic frequency wave. As seen in the figures, the attenuation of the fundamental frequency wave becomes minimum around 4 GHz, where the reflection ratio is below −30 db. In other words, the reflected power of the incident fundamental wave is below 1/1000 of the incident power. On the other hand, at 8 GHz which is the second-harmonics of the fundamental wave, the reflection ratio of the 8 GHz wave is approximately 0 db, that is, the incident wave is almost completely reflected. In other words, the second-harmonics frequency wave passing by the stubs is below −40 db, that is, below 1/10000 of the incident power.

Figure 10A:
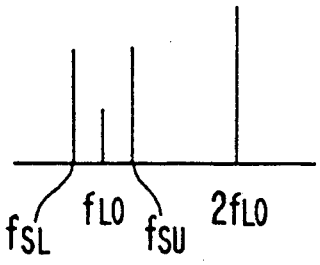
FIGS. 10(*a*) to 10(*b*) show frequency spectrums observed at the input and output of the filter circuit of the present invention.
Figure 10B:
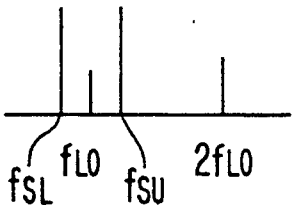

FIGS. 10 show frequency spectrums at the input and out put of the FIG. 6 filter circuit. As seen there, the second-harmonic frequency wave $2f_{LO}$ of the local oscillator signal $f_{LO}$ is attenuated by the circuit. Waves $f_{SL}$ and $f_{SU}$ denote lower and upper sidebands of the local oscillation signal $f_{LO}$, respectively. These three waves are not attenuated at all after passing through the filter.

Though in the above-described preferred embodiments the value of the notation n is chosen zero as a simplest example, it is apparent that the value may be any other positive integer, such as 1, 2 . . .

Moreover, though in the above described preferred embodiments the numeral n is common for the first stub 4 and the second stub 5 or 6, the first stub 4 can be arbitrarily combined with the second stub 5 or 6 which has a different n value than that of the first stub 4 as long as the susceptance exhibited by the stub is equivalent to those of the common n value. For example, referring to the voltage standing waves in FIGS. 6, it is seen that a stub of n=0 can be interchangable with a stub of n=2. In a same way, a stub of n=1 can be interchangable with a stub of n=3, though which is not shown in the figures. Summarizing this facts, a stub of a certain integer n can be interchangable with a stub of n+2.

Though the third preferred embodiment shown in FIG. 8 comprises two of open stubs. The concept of the third preferred embodiment may be embodied with the constitution of the second preferred embodiment having one open stub and one short stub.

Though in the third preferred embodiment shown in FIG. 8 a bent stub is embodied for the second stub, it is apparent that the concept of the bent stub may be embodied also for the first stub or both of the two stubs.

Though in the above-described preferred embodiments the characteristic admittances of the main transmission line 2, the open stubs 4, 5 and 51 are chosen the same, each characteristic admittance, i.e. width of the strip electrode of the transmission line, may be different from each other as long as the required performances, such as the pass band characteristics of the fundamental wave and the attenuation characteristic of the second-harmonic wave, are satisfied. Change of the width of the electrode of the strip-type transmission line causes not only a change in its characteristic admittance but also a change in its propagation constant. Accordingly, wavelength in the transmission line is also changed the wavelength Lg in the formula the length of the stub must be adjusted according to the of the respective strip line electrode. In to easily achieve the conjugate susceptance the two stubs, the characteristics impedances of the first and the second stubs are preferably chosen same to or higher than that of the main transmission line.

An adjustment of the choke filter circuits of the preferred embodiments can be easily by adjusting the stub length or the width, or adding a to the stub.

Though in the above-described embodiments the stubs are rectangularly connected the main transmission line, the stub may be to the main transmission line by an arbitrary angle as long as rne performances are satisfactory.

Furthermore, it is beneficial advantage of the filter structure of the present invention the location of the connection of the stubs can be arbitrary chosen along the main transmission line, and the bent stub structure of FIG. 8 provides more area available for the circuits to be installed more easily even in a limited area than the first preferred embodiment, without being divided by the existance of the stub.

The many features and advantages of the invention are apparent from the detailed specification and thus, it is intended by the appended claims to cover all such features and advantages of the system which fall within the true spirit and scope of the invention. Further, since numerous modifications and changes may readily occur to those skilled in the art, it is not desired to limit the invention to the exact construction and operation shown and described, and accordingly, all suitable modifications and equivalents may be resorted to, falling within the scope of the invention.

What is claimed is:

1. A second-harmonics choking filter of a strip-type transmission line, comprising:

a main transmission line through which an electromagnetic wave having a fundamental frequency is to be transmitted;

a first open stub having a length of substantially $Lg(2n+1)/8$, Lg denoting an effective wavelength of the fundamental frequency on said first open stub, numeral n denoting an integer greater than negative one, said first open stub being operatively connected to a side of said main transmission line; and a second open stub having a length of substantially $Lg'(2m+3)/8$, Lg' denoting an effective wavelength of said fundamental frequency on said second open stub, numeral m being equal to said numeral n, said second open stub being operatively connected to said main transmission line vis-a-vis said first open stub, whereby the fundamental frequency of the electromagnetic wave is transmitted through said main transmission line without being substantially attenuated and a second harmonic of the fundamental frequency of the electromagnetic wave is substantially choked to prevent propagation along said main transmission line.

2. A second-harmonics choking filter of a strip-type transmission line as recited in claim 1, wherein a part of said second open stub is bent apart from a direction in which said second open stub is connected to said main transmission line.

3. A second-harmonics choking filter of a strip-type transmission line as recited in claim 2, wherein said bent part of said second open stub is substantially parallel to said main transmission line.

4. A second-harmonics choking filter of a strip-type transmission line as recited in claim 3, wherein a gap between said parallel part of said second open stub and said main transmission line is at least equal to or more than the widths of said main transmission line and of said second open stub.

5. A second harmonics choking filter of a strip-type transmission line, comprising:

a main transmission line through which an electromagnetic wave having a fundamental frequency is transmitted;

a first open stub exhibiting a first susceptance value for the fundamental frequency and exhibiting a substantially infinite admittance value for a second harmonic of the fundamental frequency, said first open stub being operatively connected to a side of said main transmission line; and a second open stub exhibiting a second susceptance value which is substantially a conjugate of the first susceptance value for the fundamental frequency, and exhibiting a substantially infinite admittance value for the second harmonic of the fundamental frequency, said second open stub being operatively connected to said main transmission line vis-a-vis said first open stub, whereby the fundamental frequency of the electromagnetic wave is transmitted through said main transmission line without being substantially attenuated and the second harmonic of the fundamental frequency of the electromagnetic wave is substantially prevented from propagating along said main transmission line.

6. A second-harmonics choking filter of a strip-type transmission line as recited in claim 5, wherein said first and second stubs are respectively formed of strip-type transmission lines.

7. A second-harmonics choking filter of a strip-type transmission line, comprising:

a main transmission line through which an electromagnetic wave having a fundamental frequency is to be transmitted;

a first open stub having a length of substantially $Lg(2n+1)/8$, Lg denoting an effective wavelength of the fundamental frequency on said first open stub, numeral n denoting an integer greater than negative one, said first open stub being operatively connected to a side of said main transmission line; and a second open stub having a length of substantially $Lg'(2m+3)8$, Lg' denoting an effective wavelength of said fundamental frequency on said second open stub, numeral m being equal to said numeral $n+2$, said second open stub being operatively connected to said main transmission line vis-a-vis said first open stub, whereby the fundamental frequency of the electromagnetic wave is transmitted through said main transmission line without being substantially attenuated and a second harmonic of the fundamental frequency of the electromagnetic wave is substantially choked to prevent propagation along said main transmission line.

8. A second-harmonics choking filter of a strip-type transmission line as recited in claim 7, wherein a part of said second open stub is bent apart from a direction in which said second open stub is connected to said main transmission line.

9. A second-harmonics choking filter of a strip-type transmission line as recited in claim 8, wherein said bent part of said second open stub is substantially parallel to said main transmission line.

10. A second-harmonics choking filter of a strip-type transmission line as recited in claim 9, wherein a gap between said parallel part of said second open stub and said main transmission line is at least equal to or more than the widths of said main transmission line and of said second open stub.

* * * * *

UNITED STATES PATENT AND TRADEMARK OFFICE

CERTIFICATE OF CORRECTION

PATENT NO. : 4,999,596

DATED : March 12, 1991

INVENTOR(S) : Nakatani et al.

It is certified that error appears in the above-identified patent and that said Letters Patent is hereby corrected as shown below:

On the title page, item, [54] "CHOCKING" should be --CHOKING--.

Col. 1, line 1, "CHOCKING" should be --CHOKING--.

Col. 3, line 50, "√" should be --ε--.

Col. 7, line 6, "changed the" should be --changed. Therefore, the--;

line 7, "formula the" should be --formula determining the--;

line 8, "to the of the" should be --to the width of the--;

line 9, "In to" should be --In order to--;

line 10, "tance" should be --tance value of--;

UNITED STATES PATENT AND TRADEMARK OFFICE

CERTIFICATE OF CORRECTION

PATENT NO. : 4,999,596

DATED : March 12, 1991

INVENTOR(S) : Nakatani et al.

It is certified that error appears in the above-identified patent and that said Letters Patent is hereby corrected as shown below:

Col. 7, line 15, "easily by" should be --easily done by--;

line 16, "a to" should be --a foil to--;

line 17, after "above-described" insert --preferred--;

line 19, "be to" should be --be connected to--;

line 20, "rne" should be --the--;

line 23, "invention the" should be --invention that the--.

Signed and Sealed this

Eighteenth Day of August, 1992

*Attest:*

*Attesting Officer*

DOUGLAS B. COMER

*Acting Commissioner of Patents and Trademarks*